US006899332B2

(12) United States Patent
Weisman

(10) Patent No.: US 6,899,332 B2
(45) Date of Patent: May 31, 2005

(54) GAME PIECE AND METHOD OF PLAYING A GAME AND SUPPLYING THE GAME PIECE

(75) Inventor: Jordan K. Weisman, Redmond, WA (US)

(73) Assignee: WizKids LLC, Bellevue, WA (US)

( * ) Notice: Subject to any disclaimer, the term of this patent is extended or adjusted under 35 U.S.C. 154(b) by 0 days.

(21) Appl. No.: 09/958,201

(22) PCT Filed: Jan. 16, 2001

(86) PCT No.: PCT/US01/01369

§ 371 (c)(1),
(2), (4) Date: Oct. 5, 2001

(87) PCT Pub. No.: WO01/58544

PCT Pub. Date: Aug. 16, 2001

(65) Prior Publication Data

US 2002/0180150 A1 Dec. 5, 2002

Related U.S. Application Data

(60) Provisional application No. 60/182,002, filed on Feb. 11, 2000, and provisional application No. 60/224,314, filed on Aug. 10, 2000.

(51) Int. Cl.[7] ..... A63F 3/00

(52) U.S. Cl. ..... 273/289; 273/288; 273/142 R; 40/495; 40/113; 40/486; 116/309; 116/311; 116/312

(58) Field of Search ..... 273/289, 288, 273/142 R; 434/106, 198; 40/113, 486, 495; 116/309, 311, 312

(56) References Cited

U.S. PATENT DOCUMENTS

| | | | | |
|---|---|---|---|---|
| 1,762,269 | A | * 6/1930 | Harris | 273/289 |
| 3,856,309 | A | * 12/1974 | Helfgott | 273/289 |
| 3,945,640 | A | 3/1976 | Denmark | |
| 4,083,564 | A | 4/1978 | Matsumoto | |
| 4,211,410 | A | * 7/1980 | Smith | 273/247 |
| 4,498,674 | A | 2/1985 | Ferris et al. | |
| 4,534,567 | A | * 8/1985 | Ferris et al. | 273/255 |
| 4,634,129 | A | 1/1987 | Martinez | |
| 4,941,665 | A | 7/1990 | Klamer | |
| 4,948,135 | A | 8/1990 | Follety, Jr. | |
| 4,973,053 | A | 11/1990 | Kobayashi | |
| 5,340,105 | A | 8/1994 | Gostyla | |
| 5,484,287 | A | 1/1996 | Concepcion-Diaz | |
| 5,584,484 | A | 12/1996 | Kenvyn | |
| 5,758,777 | A | 6/1998 | Dods | |
| 5,927,715 | A | 7/1999 | Novello | |
| 6,659,463 | B2 | 12/2003 | Mackey | |

OTHER PUBLICATIONS

Mattel Dark World Game like Heroquest + XTRAS, eBay <http://cgi.ebay.com/aw–cgi/ eBayISAPI.dll?ViewItem&item=565530968>, downloaded Mar. 8, 2001.

The Adventurers Guide to DarkWorld, 1992, 10pages, Mattel Inc., El Segundo, California, USA.

* cited by examiner

*Primary Examiner*—Benjamin Layno
(74) *Attorney, Agent, or Firm*—George C. ROndeau, Jr.; Davis Wright Tremaine LLP

(57) ABSTRACT

A method and an apparatus by which rules and record keeping in games employing miniature figures as game pieces are incorporated onto the base of the miniature figures themselves. Counters or wheels keep track of a character's characteristics and how they change as a game progresses. Values can be customized for each character by providing differently numbered wheels for the bases. Also, a method for providing collectable game pieces with varied features by providing them to the consumer concealed in packaging.

102 Claims, 7 Drawing Sheets

FIG. 8

MiniWars Combat Dials

Key for Special Abilities:

aq: Aquatic
ba: Body Armor
be: Berserk
bf: Battle Fury
fl: Flame/Lightning
ft: Flight
he: Healing
ly: Lycanthropy
R: Range
D: Damage
ma: Magic Attack
mb: Morale Broken
mg: Magic Guidance
mh: Magic Healing
ms: Melee Specialist
ne: Necromancy
pb: Psionic Blast
pm: Protection from Magic
pr: Protection
qu: Quickness
re: Regeneration
sp: Starting Position
st: Stealth
to: Toughness
va: Vampirism

HUMANS

Irregular R:^6 D:1 Rank: Standard Pt: 6-8

| | 1 | 2 | 3 | 4 | 5 | 6 | 7 | 8 | 9 | 10 | 11 | 12 |
|---|---|---|---|---|---|---|---|---|---|---|---|---|
| **Mv** | 8 | 7 | 6 | 4 | 3 | 2 | X | | | | | |
| **At** | 8 | 7 | 5 | 0 | 0 | 0 | X | | | | | |
| **Df** | 15 | 14 | 13 | 12 | 11 | 10 | X | | | | | |
| | | | | mb | mb | mb | | | | | | |

Rifleman R:^10 D:2 Rank: Standard Pt: 10-12

| | 1 | 2 | 3 | 4 | 5 | 6 | 7 | 8 | 9 | 10 | 11 | 12 |
|---|---|---|---|---|---|---|---|---|---|---|---|---|
| **Mv** | 8 | 7 | 6 | 5 | 3 | 2 | X | | | | | |
| **At** | 8 | 7 | 6 | 5 | 0 | 0 | X | | | | | |
| **Df** | 16 | 15 | 14 | 13 | 11 | 10 | X | | | | | |
| | ba | | | | mb | mb | | | | | | |

Skirmisher R:^6 D:1 Rank: Standard Pt: 10-12

| | 1 | 2 | 3 | 4 | 5 | 6 | 7 | 8 | 9 | 10 | 11 | 12 |
|---|---|---|---|---|---|---|---|---|---|---|---|---|
| **Mv** | 8 | 7 | 4 | 3 | X | | | | | | | |
| **At** | 5 | 4 | 0 | 0 | X | | | | | | | |
| **Df** | 15 | 13 | 11 | 10 | X | | | | | | | |
| | qu | | mb | mb | | | | | | | | |

Shield Maiden R:^0 D:1 Rank: Standard Pt: 9-11

| | 1 | 2 | 3 | 4 | 5 | 6 | 7 | 8 | 9 | 10 | 11 | 12 |
|---|---|---|---|---|---|---|---|---|---|---|---|---|
| **Mv** | 8 | 6 | 4 | 2 | X | | | | | | | |
| **At** | 4 | 3 | 0 | 0 | X | | | | | | | |
| **Df** | 17 | 15 | 12 | 10 | X | | | | | | | |
| | pr | pr | mb | mb | | | | | | | | |

Swashbuckler R:^4 D:2 Rank: Standard Pt: 10-12 Note: 120 degree front arc.

| | 1 | 2 | 3 | 4 | 5 | 6 | 7 | 8 | 9 | 10 | 11 | 12 |
|---|---|---|---|---|---|---|---|---|---|---|---|---|
| **Mv** | 8 | 7 | 6 | 4 | 3 | 2 | X | | | | | |
| **At** | 7 | 5 | 3 | 2 | 0 | 0 | X | | | | | |
| **Df** | 15 | 14 | 13 | 12 | 11 | 10 | X | | | | | |
| | ms | | | | mb | mb | | | | | | |

Field Medic R:^0 D:2 Rank: Standard Pt: 11-13

| | 1 | 2 | 3 | 4 | 5 | 6 | 7 | 8 | 9 | 10 | 11 | 12 |
|---|---|---|---|---|---|---|---|---|---|---|---|---|
| **Mv** | 8 | 7 | 6 | 5 | 2 | X | | | | | | |
| **At** | 5 | 4 | 3 | 2 | 0 | X | | | | | | |
| **Df** | 14 | 13 | 12 | 11 | 10 | X | | | | | | |
| | he | he | he | | mb | | | | | | | |

Fig. 10

MiniWars Special Abilities Card

*Move* Special Abilities

Red: *Quickness*. This warrior may not be part of a *Movement Formation*. You may give this warrior a *Move* action which does not count against your "one action per turn" limit. You may not give this warrior two actions during the same turn. Use of this ability is optional.

Light Blue: *Aquatic*. This warrior is unhindered while moving through water terrain features. This warrior may move through water at full *speed* value. Use of this ability is optional.

Orange: *Flight*. This warrior is capable of short-range flight. Movement of this warrior is never blocked by figure bases or blocking terrain. The presence of hindering terrain does not halve this warrior's *speed* value. This warrior still has to roll a die to *Move* if it is in contact with an opposing warrior's base. Use of this ability is optional.

Black (White Type): *Stealth*. A *Line of Fire*, drawn to this warrior, which passes through any hindering terrain, is treated as though it has been drawn through blocking terrain. Use of this ability is optional.

*Attack* Special Abilities

Medium Green: *Healing*. This warrior may use the *Close Combat* action against friendly figures, and if a hit is obtained, this warrior's *damage* value repairs that many clicks to the friendly target figure instead of inflicting damage. Use of this ability is optional. This warrior may make a *Close Combat* attack normally.

Red: *Melee Specialist*. Whenever this warrior scores a hit with a *Close Combat* attack, roll one six-sided die. This is the number of clicks of damage you deliver to the target figure. Do not use this warrior's normal *damage* value. Use of this ability is optional.

Light Blue: *Magic Attack*. When this warrior is given a *Ranged Combat* action, the *Line of Fire* is never considered blocked or hindered by the presence of terrain or other figures. Whenever this warrior scores a hit with this attack, roll one six-sided die. This is the number of clicks of damage you deliver to the target figure. Do not use this warrior's normal *damage* value. Use of this ability is optional.

Orange: *Flame/Lightning*. This warrior's *Ranged Combat* attacks are never blocked by the bases of other figures. All figure bases (friends and foes) intersected by the *Line of Fire* are affected by the attack roll. Only one dice roll is made, but multiple targets can be affected.

Yellow: *Psionic Blast*. Any *Ranged Combat* action you give this warrior affects every other figure (friends and foes) within a circle around this warrior out to its *range* value. *Lines of Fire* are never considered blocked or hindered by the presence of terrain or other warriors.

Black (White Type): *Vampirism*. Whenever this warrior deals any amount of damage to a target figure during a *Close Combat* attack, you may repair one click to this warrior.

Grey: *Magic Healing*. This warrior may use the *Ranged Combat* action against friendly figures, and if a hit is obtained, this warrior's *damage* value repairs that many clicks to the target instead of inflicting damage. Use of this ability is optional. This warrior may make a *Ranged Combat* attack normally.

GAME PIECE AND METHOD OF PLAYING A GAME AND SUPPLYING THE GAME PIECE

This application claims the benefit of provisional application No. 60/182,002 filed Feb. 11, 2000 and Ser. No. 60/224,314, filed Aug. 10, 2000, both abandoned.

FIELD OF THE INVENTION

The invention relates to games involving the use of miniatures to represent characters in the games, and to apparatus for use in such games.

BACKGROUND OF THE INVENTION

A degree of realism can be added to games, especially war and fantasy games, through the use of miniature figures to represent characters in the games. Each participant in the game manipulates characters, each represented by a miniature figure and each being endowed with certain characteristics, e.g., strength and range of movement, that enter into the resolution of a given event, such as a battle or other interface between characters. As the complexity of each character and each scenario grows, and as the number of characters increases, the complexity of the game increases.

Traditionally, miniature figures are made of metal and sold individually or in sets. Typically, the packaging of the figures is at least partially transparent allowing the consumer to view the shape and identity of each figure prior to purchasing. Alternatively, when the packaging is not transparent, the contents of the package are clearly identified. Therefore, because purchasers are allowed to choose a specific figure for their collection, the potential market for trading these figures is minimized.

SUMMARY OF THE INVENTION

The more complicated prior art games require voluminous rules of play manuals. These manuals include massive amounts of rules and statistics for all of the figures in the game. The number of included statistics makes it difficult for a player to find a specific figure's statistics. In addition, a player is limited to figures included in their specific manual. Further, the rules often entail detailed record keeping by the players, which are often recorded on miscellaneous slips of paper that can become misplaced or disorganized.

One challenge of miniature games for a broad audience has always been the size and complication of the rules and the need for record keeping for each figure within the game. In addition, due to the nature of the packaging, the manufacturer of the figures has little control over the collectibility of the figures.

The solution to these problems is to: (i) take both the statistics pertaining to a specific character and the recording of game effects upon that character and incorporate them within each figure; and (ii) modify the packaging to conceal the randomly inserted figures to encourage the collectability of the figures.

Accordingly, the invention described herein provides a method and an apparatus by which rules and record keeping are incorporated onto the game piece base of the miniature figures themselves with a self-contained record-keeping device. Therefore, a player can use the purchased figures immediately in a game, as opposed to first finding the correct statistics book for that specific character. This device includes counter-wheels having numbers, colors, or other indicia that reflect the nature and values of a character's characteristics and how they change as a game progresses. Values can be customized for each character by providing differently-numbered wheels for the game piece bases.

According to the present invention, the game pieces are preferably molded in plastic, pre-painted, and randomly inserted into opaque packages. The packaging is designed to conceal the identity of the figure from the purchaser. These game pieces are produced in different quantities. As a result, some are designed to be rare and very collectible. The players buy packages of game pieces to try to collect the army that the player wants to amass and play with. Typically, the rareness of a game piece corresponds to the value of that game piece. In other words, a rarer game piece is more effective in the game. This method of packaging, selling, and collecting game piece miniatures has the advantage of being unique. The game playing, manufacturing, packaging, selling, and collecting may be performed using game piece bases with or without an attached figure.

Other features and advantages of the invention will become apparent to those skilled in the art upon review of the following detailed description, claims, and drawings.

BRIEF DESCRIPTION OF THE DRAWINGS

FIG. 8 is a sample of combat data for a selection of human characters to be represented by such game piece bases as illustrated in FIG. 1.

FIG. 10 is a sample of a special abilities card to be used in conjunction with a game piece base such as that illustrated in FIG. 1.

Figure 1:
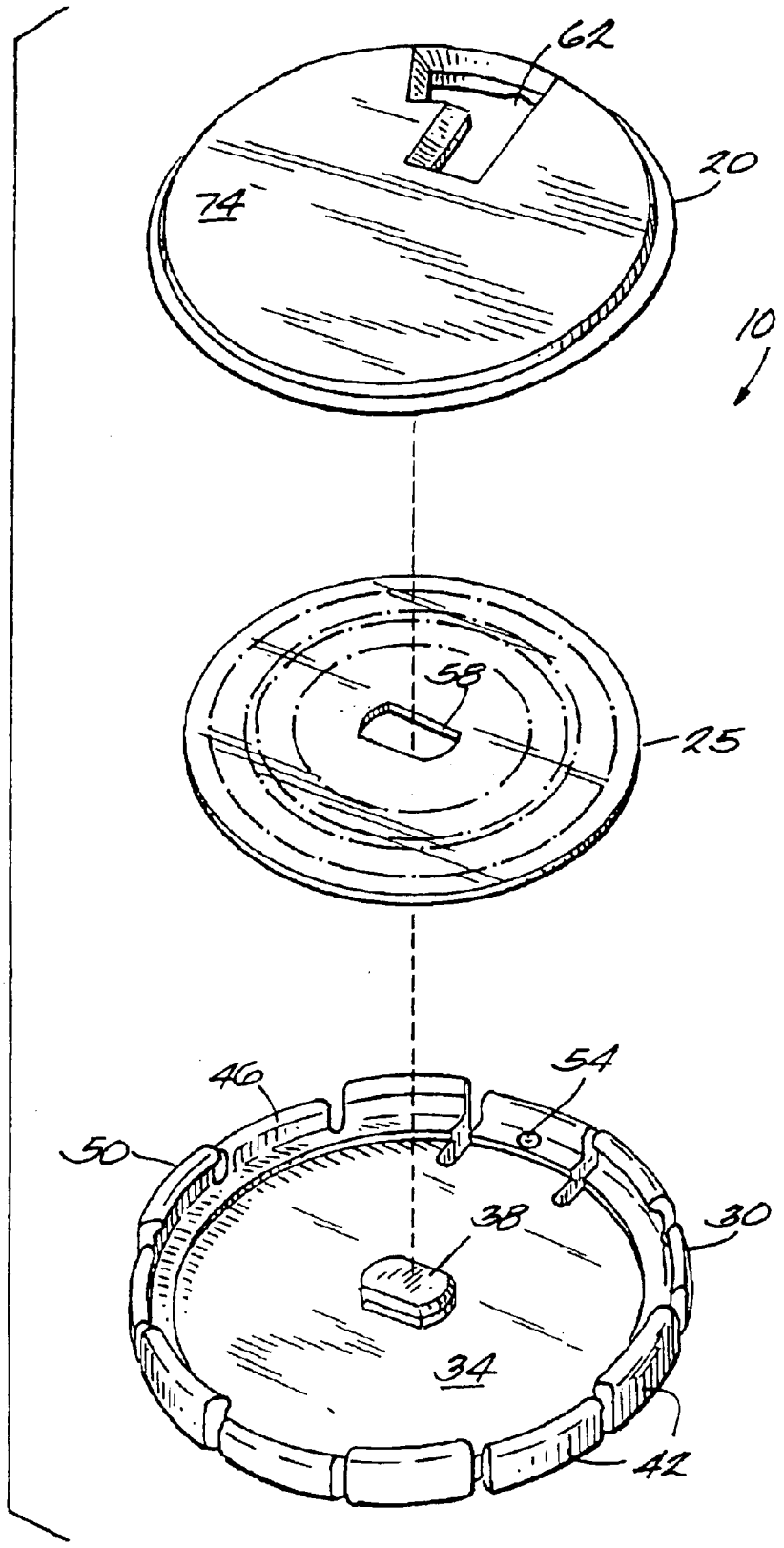
FIG. 1 is an exploded schematic representation of a game piece base embodying the invention.
Figure 2:
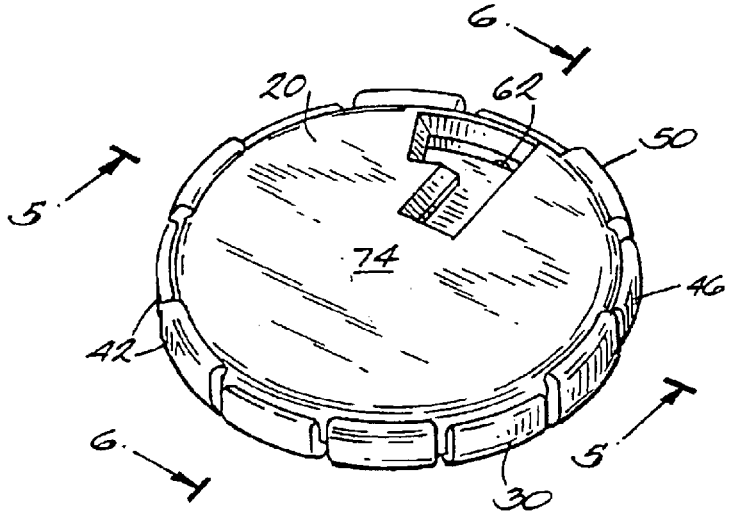
FIG. 2 is a perspective view of the game piece base illustrated in FIG. 1.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENTS

Miniature figures are often used in games, especially war and fantasy games, to represent characters in the games.

These characters, for example, can be a Roman legionnaire, a Civil War Union soldier, a magician, or a mythical beast, depending on the game. Games can be played to re-enact historical battles, such as the Spartan defense of Thermopylae against the invading Persian army under King Xerxes, or to create a fantastical battle such as one pitting elves and humans against trolls and orcs. Each participant in the game commands an army of characters, each represented by a miniature figure. Each character is endowed with certain strengths and weaknesses, all of which enter into the resolution of a given battle. To add interest to the battle, other factors such as magic and terrain can also be included.

As the complexity of each character and each scenario grows, and as the number of characters increases, the complexity of the game increases. The challenge of miniature games for players is the extensive and complicated nature of the rules and the need for record keeping for each figure within the game. In this description, the terms warrior and game piece are used interchangeably to describe the invention.

FIG. 1 illustrates a game piece base 10 designed to ease the complexity of such games. Each game piece base 10 is a self-contained record-keeping device that includes a base disk 20, a label 25, and a selector disk 30.

The selector disk 30 includes an upper surface 34, a post 38 mounted in the center of the selector disk 30, and a plurality of fingers 42 mounted at the periphery of the selector disk 30. The plurality of fingers 42 includes six short fingers 46 alternating with six long fingers 50. In alternate embodiments, any other suitable number or sizing of fingers may be used. One of the short fingers 46 includes a button 54 formed therewith and rising vertically from the upper surface 34.

The label 25 including an aperture 58 is attached to the upper surface 34 of the selector disk 30 such that the aperture 58 aligns with the post 38. A series of numbers in twelve columns of three appears on the label (not shown). Each column is spaced at approximately thirty-degree intervals around the label. In alternate embodiments, any other suitable arrangement of numbers can be used.

Figure 3:
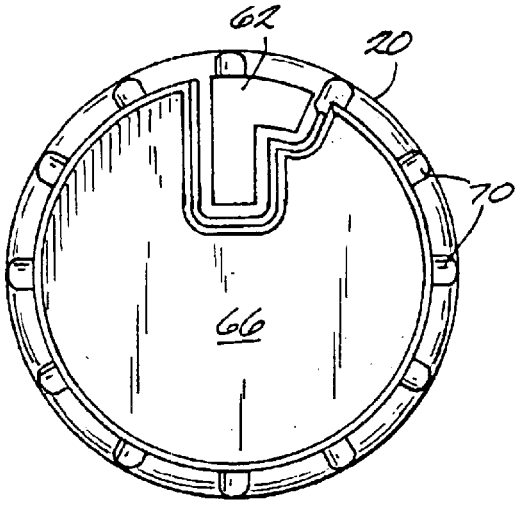
FIG. 3 is a plan bottom view of a base disk of the game piece base illustrated in FIG. 1.
Figure 4:
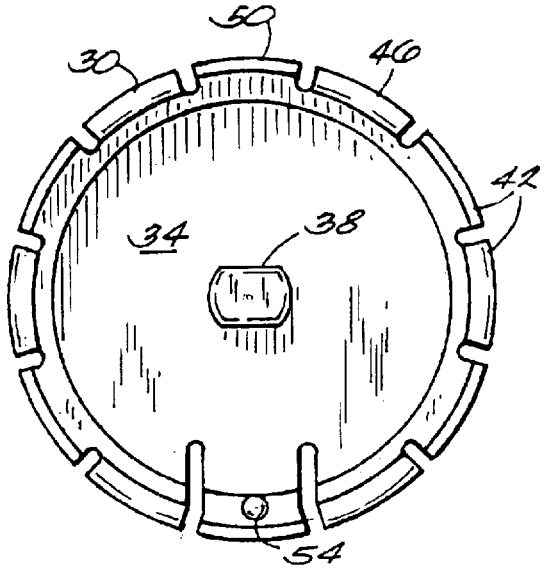
FIG. 4 is a plan top view of a selector disk of the game piece base illustrated in FIG. 1.

The base disk 20 includes an L-shaped stat slot or aperture 62 that allows one column of numbers and additional data from the label 25 to be seen at a given position of the base disk 20 relative to the selector disk 30. As illustrated in FIG. 3, the base disk 20 also includes a bottom surface 66, and a plurality of indentations 70 in the periphery of the bottom surface 66. The number of indentations should match the number of fingers 42 on the selector disk 30. The base disk 20 also includes an upper surface 74.

Figure 5:
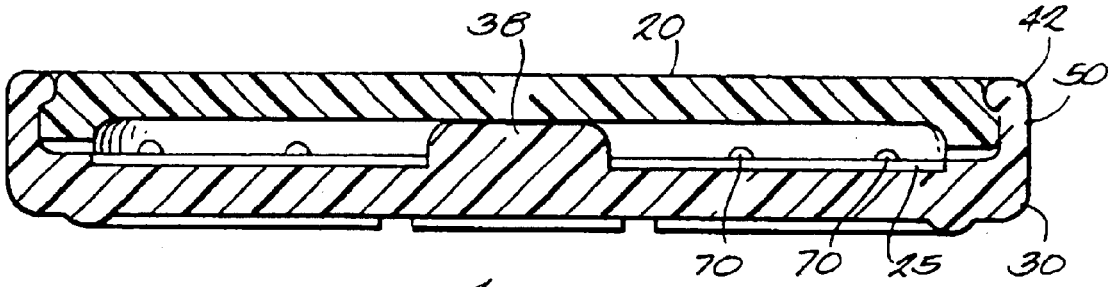
FIG. 5 is a cross-section view taken along line 5—5 in FIG. 2.
Figure 6:
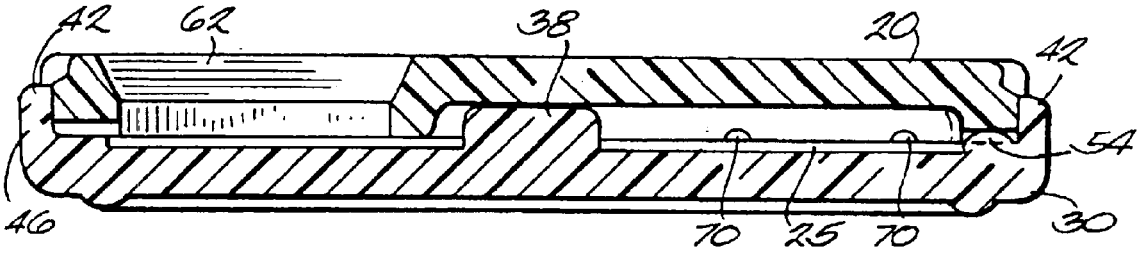
FIG. 6 is a cross-section view taken along line 6—6 in FIG. 2.

When assembled, as illustrated in FIGS. 5 and 6, the label 25 is applied to the upper surface 34 of the selector disk 30, and the base disk 20 fits within and is captured by the fingers 42 of the selector disk 30. The center of the bottom surface 66 of the base disk 20 is supported by the post 38. This arrangement allows the selector disk 30 to be rotated relative to the base disk 20. The button 54 interacts with the indentations 70 such that the button 54 resides partially within an indentation 70 when that indentation 70 is aligned with the button 54. The fingers are sufficiently flexible to allow the button 54 to snap into and out of an indentation 70 as the selector disk 20 is rotated relative to the base disk 20. Such an arrangement ensures that the base disk 20 will only occupy a given number of discrete indexed positions relative to the selector disk 30, where the given number of discrete positions is equal to the number of indentations 70, and where each discrete position allows a player to look through the slot 62 to see whatever numbers, symbols, or colors may appear on the label 25 at that location. In other words, the two disks 20, 30 are typically aligned such that a column of numbers appears in the slot 62. The fingers 42 provide a gripping surface such that a player can manually rotate the selector disk 30 relative to the base disk 20.

Figure 7:
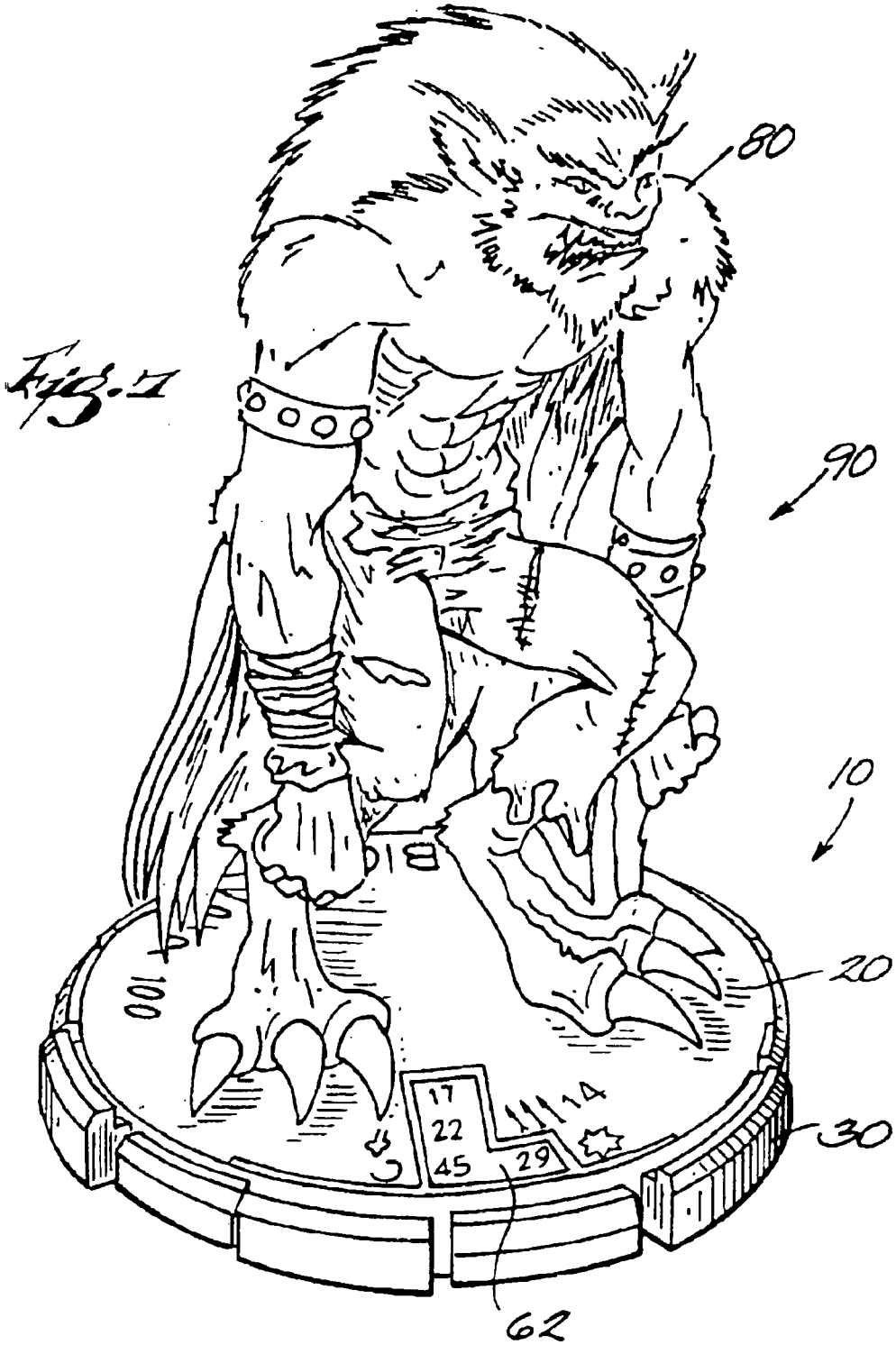
FIG. 7 is a perspective view of alternate embodiment of the game piece base illustrated in FIG. 1, including a representational figure.

As illustrated in FIG. 7, a figure 80 may be attached to the upper surface 74 of the base disk 20 to form a game piece or warrior 90. The figure 80 may be any representational figure representing a character in a game.

In other embodiments (not shown), the described game piece base 10 may be any record-keeping device, such as mechanical and electronic counters that are suitable for recording and conveying information. Specifically, the game piece base 10 allows for the variation of indicia during the course of play. In still other embodiments, the figure 80 may be any suitable type of figure, including humans, animals, and mythical, mechanical, or fantastical creatures. The game piece base 10 may be made available in conjunction with or separately from the figure 80 to allow for interchangeability between figures 80 and bases, or to allow one to acquire a base to match a figure 80 one already has.

As is described in more detail below, the design of the game piece base 10 means that each game piece base 10 carries with it a complex two dimensional table that reflects a character's performance statistics at up to twelve stages of damage, where each discrete location of the base disk 20 with respect to the selector disk 30 represents a stage of damage. In alternate embodiments, other numbers of discrete locations can indicate other stages of damage. Examples of such tables are shown in FIG. 8 for a selection of human characters. Thus, the game piece base 10 provides both the table and the current performance of the character, eliminating voluminous rulebooks and record keeping.

The game pieces 90 are preferably molded in plastic, pre-painted, and randomly inserted into opaque packages 94 that are preferably glued closed or shrink wrapped to prevent opening. The package 94 is designed to conceal the identity of the warrior 90 from the purchaser. These game pieces 90 are produced in different quantities. As a result, some are designed to be rare and very collectible. The players buy packages 94 to try to collect the game pieces 90 that the player wants to amass and play with. Typically, the rareness of a game piece 90 corresponds to the value of that game piece 90. In other words, a rarer game piece 90 is more effective in the game. This method of packaging, selling, and collecting game piece miniatures has the advantage of being unique.

Figure 9:
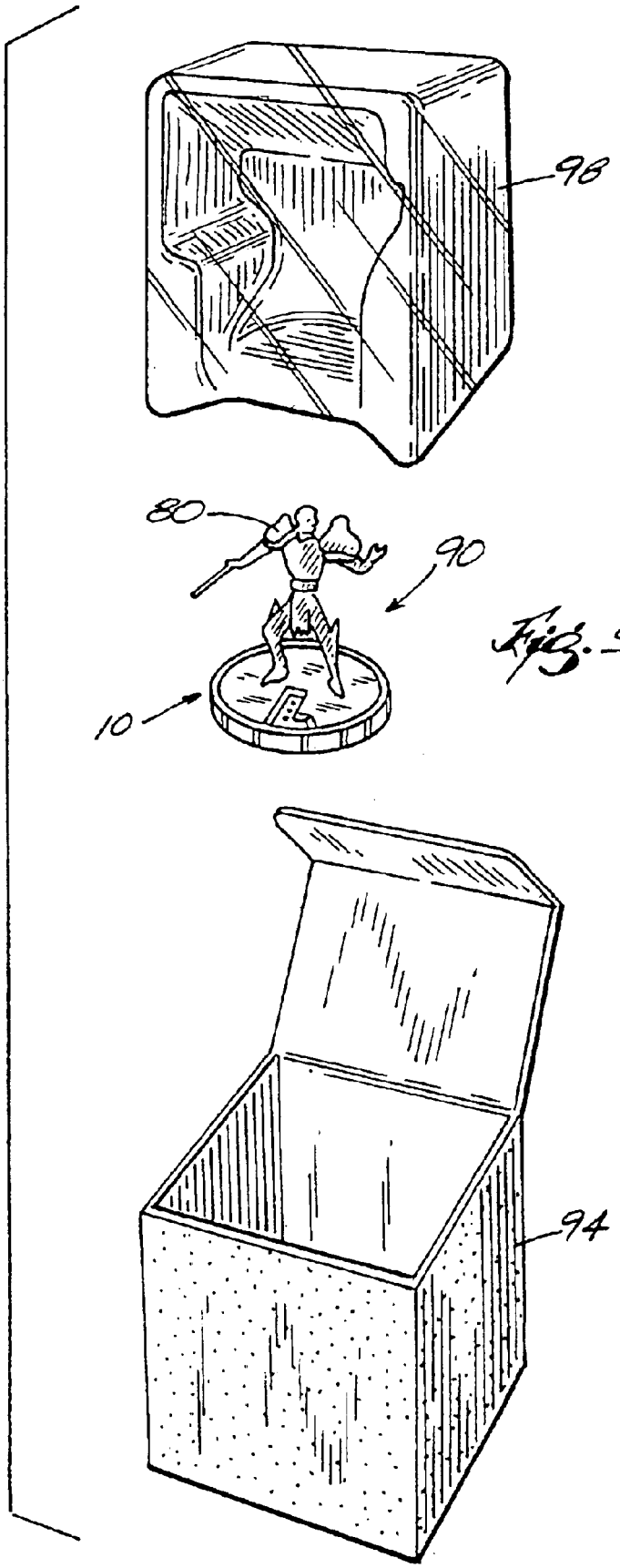
FIG. 9 is an exploded perspective view of a method of packaging a game piece base such as that illustrated in FIG. 7.

These packages 94 can either include a single warrior 90, as shown in FIG. 9 with a plastic insert 98, or multiple warriors 90. Preferably, the figures 80 are supplied in sets of five (booster packs) or ten (starter sets) because it improves the purchaser's chances of getting a desired figure 80. When the multiple figures 80 are sold in a single package, retailers are more likely to carrying the product line because consumers are more likely to buy in volume. Retailers also appreciate that the concealing packages use minimal shelf space and only require a single stock keeping unit ("SKU") as opposed to the one hundred and sixty SKU's (i.e., one for each character) that would be necessary if the warriors were sold in individual non-concealing packages.

The booster pack includes five figures 80 and five stickers to place on the bottom of each figure 80 on which the owner can write their name. The starter set includes ten figures 80, a rulebook, a comic book to explain the fiction of the game world, a pair of dice, a flexible ruler for measuring distances, and 10 identifying stickers. The purpose for each of these items will be discussed in more detail below.

Alternatively, the packages can be configured to reveal the identity of the warrior 90 to allow the purchaser to select specific characters for their collection. But to facilitate trading of such figures 80, the individual characteristics printed on the label 25 can be concealed by the packaging and varied between identical characters. These different printed labels 25 can be produced in varied quantities. As a result, some can be designed to be rare and very collectible. For example, identical characters can have different indicia printed on the label 25 making one figure 80 faster, stronger, and less susceptible to injury than another according to the rules of the game. Therefore, the more valuable warriors 90 of this embodiment would be those with more favorable numerical characteristics. The purchaser would then have the opportunity to more easily acquire the different warriors 90 and still be encouraged to trade for those warriors 90 that possess superior numerical characteristics.

Although the invention described herein may be used for a wide variety of games, a game called MAGE KNIGHT REBELLION will be used as an example to illustrate the invention. In MAGE KNIGHT REBELLION, a player takes on the role of a powerful warlord, king, baron, or high wizard who sends his warriors 90 out to do battle with opposing armies. MAGE KNIGHT REBELLION is a game of tabletop combat using collectible MAGE KNIGHT REBELLION figures 80. Each figure 80 is called a warrior 90, and is a member of one of eight different factions: Atlantis Guild, Elemental League, Necropolis Sect, Black Powder Rebels, Knights Immortal, Orc Raiders, Draconum, or Mage Spawn. A player builds an army from his or her collection of warriors 90. A game may be played using game piece bases 10 with or without an attached figure 80.

A warrior 90 is composed of two main pieces, the figure 80 and the game piece base 10. The game piece base 10 shows sets of numbers that tell a player how good a warrior 90 is at doing certain things. Each time a warrior 90 takes a point of damage during a game, the player clicks the selector disk 30 clockwise to the next set of numbers. Each point of damage taken by a warrior 90 changes the warrior's game piece base numbers, reducing the warrior's effectiveness. Each time a warrior 90 takes a click of healing during the game, the player clicks the selector disk 20 counter-clockwise to the previous set of numbers. When three skulls show up on the game piece base, the warrior 90 has been eliminated and is removed from the battlefield.

Each warrior's game piece base 10 contains important information. This information includes the warrior's: a) name, b) point value (1-50), c) rank (weak, standard, tough), d) front arc (white), e) rear arc (gray), f) collector's number (1-160), g) faction symbol, and h) combat values. Each warrior's base also has a stat slot (to see numbers on the label 25). If a warrior 90 does not have a rank, then it is a unique figure 80. Each warrior 90 has five combat values, four that change during the game and one that stays the same. The four values that change are speed, attack, defense, and damage. These four values are on the game piece base 10, and can be seen through the warrior's stat slot 62. The fifth value, range, never changes and is printed on the base 10.

Game Items: In addition to a player's MAGE KNIGHT REBELLION warriors 90 and a rules sheet, a player needs the following items to play a MAGE KNIGHT REBELLION game: a) an eighteen inch flexible ruler and b) two six-sided dice. Additionally, a two-foot-long piece of string and a few pennies (used as tokens during the game) may be used as will be further discussed below. Optionally, a player may also collect simple terrain items.

Blank stickers are provided with each pack of MAGE KNIGHT REBELLION warriors 90 for ownership identification. A player writes their initials on the stickers and places them on the bottom of each of that player's warriors 90. This helps a player to sort out which warriors 90 are that player's at the end of each battle.

Building A Player's Army: All of the players must agree to a build total of each player's army. The build total is the total of a player's point values and is always in multiples of 100 points. Each MAGE KNIGHT REBELLION warrior 90 has a point value printed on its game piece base 10. Once a player knows how many points that player has to build an army, that player chooses which of that player's warriors 90 will participate in the game. A player's army may contain two or more of the same figure 80, unless that figure 80 is unique. However, the same unique figure 80 can appear in opposing armies. The total of the player's warriors' point values cannot exceed the build total value.

Beginning the Game: MAGE KNIGHT REBELLION can be played on a flat tabletop. The players designate a square area to play that is at least three feet long on each side. A game can be played with any number of people, but the game is best when there are two, three, or four different armies. Each player selects one edge of the battlefield to be the player's, and then the game piece bases 10 of each warrior 90 are manipulated such that a green square is showing through the stat slot 62. Each player places up to two terrain items in a pile off to the side of the battlefield. The purpose of the terrain will be described in greater detail below. Next, each player rolls two six-sided dice where the highest roll determines the first player. The first player places a terrain item from the pile onto the battlefield in a desired location. This continues in clockwise order until all of the terrain items are positioned on the battlefield. Each player then places a warriors 90 on the battlefield within three inches of the player's edge and at least 8 inches away from any other edge of the battlefield, starting with the first player and rotating clockwise until all of the players are positioned.

Turns and Actions: In MAGE KNIGHT REBELLION, players alternate moving their warriors 90 and attacking opposing figures 80 to win the battle. At the beginning of a players turn, the player has a certain number of actions. This number is set for the entire game and is dependent upon the build total of the armies. A player gets one action for every one hundred points of that person's build total. For example, if the build total is 200 points, the player receives 2 actions per turn. During each players turn, that player decides which warriors 90 to give actions, however, the same warrior 90 may not be given two actions in the same turn. Actions include moving one warrior 90, performing ranged combat with one warrior 90, performing close combat with one warrior 90, or passing. Once a player has completed their allotted actions, it becomes the next player's turn, and the next player gets the same number of actions. Play proceeds with each player taking a turn.

If a player gives an action (other than pass) to the same warrior 90 on two consecutive turns, that warrior 90 takes one point of damage after completing its subsequent action. This damage represents the fatigue caused by taking actions on two consecutive turns. A player may not give any warrior 90 an action (other than pass) on three consecutive turns. If a player has trouble remembering which warrior 90 that player has given an action to on a previous turn, that player can mark that warrior 90 with a token, such as a penny, to remind that player.

Game Concepts: Distances measured for set-up, movement, or ranged combat, are always measured from the center of the game piece base 10. Two or more warriors 90 are in base contact when the bases of each are touching. Friendly figures 80 are warriors 90 that are controlled by the same player or allied teammates, and cannot target other friendly figures 80. Opposing figures 80 are any warriors 90 that are controlled by an opponent. Status of friendly and opposing figures 80 are set at the beginning of the game and cannot change by treaties or agreements.

Special Abilities: There are special colored blocks on each warrior's game piece base 10. These colors represent special abilities that warrior 90 has while they are displayed. There are four areas in which a player can find colored blocks representing the warrior's special abilities. These four areas are: 1) behind the move value, 2) behind the attack value, 3) behind the defense value, and 4) behind the damage value through the stat slot 62 on the warrior's game piece base 10. Descriptions of these special abilities appear on the MAGE KNIGHT REBELLION Special Abilities Card, an example of which is shown in FIG. 10. If a special ability is described as optional, the owning player decides if the ability is, or is not, used for the turn.

Movement: A warrior's speed value is shown on its game piece base 10. This is the maximum number of inches the warrior 90 may move when given a move action. When a player moves a warrior 90, the player physically moves the warrior 90 across the battlefield along the exact movement path. This distance can be measured by the flexible ruler. The game piece bases 10 of other warriors 90 block movement, so a player's warrior 90 may not touch or cross the game piece base 10 of any other warriors 90 during its move. When a player finishes moving a warrior 90, the figure 80 may be faced in any direction. The direction that the figure 80 is facing is important because the warrior 90 may only attack (ranged combat and close combat) out of its front arc and it is at a disadvantage when attacked in close combat through its rear arc.

If a player gives a move action to a warrior 90 that is in contact with the game piece base 10 of an opposing warrior 90, the player must break away from the contact. To break away, the player must roll a six-sided die. If the player rolls a 1, 2 or 3, the warrior 90 fails to break away and may not move this turn, although the warrior 90 may be rotated if desired. If the player rolls a 4, 5, or 6, the player warrior 90 has successfully broken away and may move normally.

If a player's warrior's movement takes it into base contact with one or more opposing figures 80, those opposing figures 80 immediately have the option to spin in place to bring any portion of their front arcs into contact with the moving warrior 90.

Ranged Combat: Ranged combat attacks represent everything from bows and gunfire, to magical spells and mind attacks. Each warrior 90 has a range value printed on its game piece base 10. If this value is greater than zero and the warrior 90 is not in contact with the game piece base 10 of an opposing warrior 90, then a player may give that warrior 90 a ranged combat action. This number represents the maximum number of inches that the warriors 90 ranged attack can reach. The number of arrow symbols shown with the warrior's range value is the maximum number of different targets the warrior 90 may attack with each ranged combat action. Certain special abilities allow ranged combat to be resolved against an increased number of targets.

When a player gives a ranged combat action to one of the player's warriors 90, the player marks the warrior's range in inches on a string with a pen or marker (or just holds it with a player's fingers). The player places the end of the string at the center of the figure's game piece base 10 and extends the string to the center of the target's game piece base 10. The path of the string is called the line of fire. If a player is firing at more than one target, the player must draw a line of fire to each of them.

The line of fire must pass through the attacking warrior's front arc, and each target must be within the range a player has marked on the string. The line of fire is blocked if it crosses any warrior's game piece base 10 (friend or foe) other than a target. If the line of fire is blocked, a player may not attack the target warrior 90. A player may check to see if a line of fire is blocked at any time. The attacking player rolls two six-sided dice and adds their values to the warrior's attack value. If the result is equal to or greater than the target's defense value, as shown on its game piece base 10, then the target is hit and damaged. When a player's warrior 90 hits a target with an attack, the target must take a number of clicks of damage equal to the attacker's damage value.

When a warrior 90 is attacking more than one target with a ranged combat attack, which is allowed when the warrior's range value is shown with more than one arrow, a player only rolls the dice once. The total of the dice plus the warrior's attack value is compared to every target's defensive value. Some targets with low defensive values may be damaged by the attack, while others with high defensive values may not be. Whenever a ranged combat action is used to attack more than one single target, the damage value of the attack, if successful, is always one, despite the warrior's normal damage value.

Close Combat: Close combat represents hand-to-hand and melee weapon attacks. If a player gives the close combat action to a warrior 90, the front arc of the warrior's game piece base 10 must be touching the target's game piece base 10. The attacking player rolls two six-sided dice and adds their values to the warrior's attack value. If the result is equal to or greater than the target's defense value as shown on its game piece base 10, then the target is hit and damaged. The player adds one to the dice roll if the warrior 90 is in contact with the rear arc of the target warrior's game piece base 10.

Damage: When a warrior 90 hits a target with a ranged or close combat attack, the warrior 90 inflicts damage in the amount of the warrior's damage value. This is the number of clicks of damage the warrior 90 has delivered to the target. The opposing player must click the target's game piece base 10 clockwise that number of clicks. The damage inflicted reduces the target's abilities, and may even eliminate the target from the game.

Rolling a "2" or a "12": Whenever a warrior 90 is making a ranged or close combat attack and rolls a "2," the warrior 90 automatically misses the target. This is called a critical miss, and-the warrior 90 must take one click of damage representing a self-inflicted wound caused by the miss. If a player rolls a "12," the warrior 90 has automatically hit the target and does one extra click of damage. Alternatively, if a player is trying to heal a warrior 90 and rolls a "12," then the healing is automatically successful and delivers one extra click of healing.

Healing: By using special abilities such as magic healing, regeneration, and vampirism, a player may repair clicks on a figure's base 10. When repairing, click the selector disk 30 counter-clockwise, but never past the figure's starting position.

Capturing: A player has the option in close combat of capturing a target instead of damaging the target. A player must declare a capture attempt before rolling the close combat dice. The defense value of the target warrior 90 is increased by two if a player is attempting to capture it. If a player hits the target, the player doesn't damage the target, but the target is captured and a player's opponent may no longer give the target an action.

Each warrior 90 may only have one captured figure 80 under that warrior's control. The capture is shown by keeping the captured figure's game piece base 10 in contact with the controlling warrior's game piece base 10 at all times. No warrior 90, friend or foe, may target a captured figure 80 for any purpose. The captured figure 80 always moves with the captured figure's controlling warrior 90 using the lowest of the two figures' movement values. The controlling warrior 90 may only be assigned a move action or a pass action; it may not initiate any further combat. The controlling warrior 90 may not be the target of an opponent's capture attempt. If a warrior 90 with a captured target is eliminated, the captured target may immediately begin operating normally.

Formations: An action that a player gives to one of the player's warriors 90 can affect other warriors 90 in a player's army of the same race by using formations. Note that a player can never be forced to use a formation if the player does not want to. A formation may never contain figures 80 from different factions, although a player may use different figures 80 from the same faction in a formation. Mage spawn figures 80 may never use formations.

Movement Formation: If three to five of a player's warriors 90 are grouped so that each one's game piece base 10 is touching the game piece base 10 of another, then the player can call this group a movement formation. When a player gives a move action to just one of these warriors 90, all of the warriors 90 in the movement formation may move at the same time and as part of that same action. At the end of the move, each warrior's game piece base 10 must still be touching the game piece base 10 of another warrior 90 in the formation. Therefore, the speed value of the slowest warrior 90 in the movement formation will restrict how far a player's warriors 90 will move. Movement formations are good because one move action allows a player to move several warriors 90 instead of just one. If any figure 80 in a movement formation fails to break away, that figure 80 may not move individually other than rotating to a new direction.

Ranged Combat Formations: If three to five of a player's warriors 90 have their game piece bases 10 touching, a player may declare a ranged combat formation. When a player gives a ranged combat action to just one of these warriors 90, all of the warriors 90 in the ranged combat formation contribute to the attack. The target figure 80 must be within the range value of each of a player's warriors 90, and no line of fire may be blocked. The warrior 90 that a player gives the ranged combat action to is called the primary firer. To resolve the attack, a player uses the primary firer's attack value and damage value. Each additional warrior 90 in the ranged combat formation adds one to the attack dice roll. There is no damage bonus. Ranged combat formations are good because they allow a player to hit and at least do some damage to target warriors 90 with very high defensive values. Even if only one warrior 90 in the formation is given the ranged combat action, all warriors 90 are considered to have performed an action.

Close Combat Formations: If two or three of a player's warriors 90 have their game piece bases 10 touching each other and a game piece base 10 of a single opposing warrior 90, a player may declare a close combat formation against that opposing warrior 90. When the player gives a close combat action to just one of a player's warriors 90, all of the warriors 90 in the close combat formation contribute to the attack. The warrior 90 that the player gives the close combat action to is called the primary attacker. To resolve the attack, the player uses the primary attacker's attack value and damage value. Each additional figure 80 in the close combat formation adds one to the combat dice roll. There is no damage bonus. Close combat formations are good because they help overcome the difficulty in capturing an opponent's warrior 90 or damaging a warrior 90 with a high defensive value. Similar to ranged combat formations, if one warrior 90 in the formation is given the close combat action, all warriors 90 are considered to have performed an action.

If a "2" is rolled during a close combat or ranged combat formation, only the primary attacker rotates his base clockwise one click.

Tabletop Terrain: Players are not required to use terrain when fighting a MAGE KNIGHT REBELLION battle, but adding terrain to the tabletop will make the game more challenging and interesting. There are four types of terrain in MAGE KNIGHT REBELLION: a) clear, b) hindering, c) blocking, and d) elevated. An empty tabletop is considered to be clear terrain.

Hindering Terrain: Examples of hindering terrain are brush, low walls, and debris. A player can represent these with construction paper, pieces of felt, fabric, or scale models. Hindering terrain should lie flat on the table so that the terrain does not interfere with the placement of a player's warriors' game piece bases 10. If a line of fire passes through any amount of hindering terrain or any number of hindering terrain features, one is added to the target's defensive value, this is called a hindering terrain modifier. Close combat attacks are not affected by hindering terrain. A player's warriors 90 can move into and through hindering terrain, but there are restrictions. If a player's warrior 90 begins a move with any part of the warrior's game piece base 10 touching clear terrain, the warrior's movement must end immediately when the warrior's game piece base 10 crosses completely into a hindering terrain feature. If a player's warrior 90 begins a move with any part of the warrior's game piece base 10 touching hindering terrain, the warrior's speed value is cut in half for the turn.

A firer in hindering terrain is not penalized by the modifier if its front arc lies entirely outside of the hindering terrain boundary and the line of fire does not pass into or through any other hindering terrain features. This represents use of the hindering terrain as protection while firing from the edge of the hindering terrain.

Blocking Terrain: Examples of blocking terrain are large trees, high walls, and buildings. A player can represent them with common items such as salt shakers, cups, and stacks of books, or the player can use scale models. Blocking terrain blocks movement, so a warrior 90 may not move through it. Also, blocking terrain blocks any line of fire crossing it.

Elevated Terrain: All elevated terrain is assumed to represent the same level of height above the battlefield. Elevated terrain features include hills and low plateaus. Elevated terrain may include areas of hindering and/or blocking terrain, but is otherwise assumed to contain clear terrain. Players can represent elevated terrain with stacks of books and magazines, or use scale models. All figures 80 must stop as soon as they move up into elevated terrain, or down out of elevated terrain (as if they were entering a hindering terrain feature). When measuring a player's move, don't measure any vertical distance traveled, just the horizontal portion of the warrior's 90 move along the tabletop or elevated terrain feature.

Elevated terrain features block lines of fire unless the firer or target or both are on the elevated terrain. If both the firer and target are on elevated terrain, nothing affects the line of fire except elevated hindering and blocking terrain features and other elevated figure 80 bases. If the firer or target is on elevated terrain, but the other is not, the line of fire is blocked if it crosses a different elevated terrain feature. Intervening blocking terrain features also block the line of fire, whether elevated or not. Intervening elevated figure 80 bases will also block these lines of fire, but those off of elevated terrain can be ignored. Hindering terrain modifies the attack only if either the firer or target is in hindering terrain, otherwise it too can be ignored.

Special Terrain: Shallow water features like streams, fords, and ponds are treated as hindering terrain for movement, but have no effect on ranged combat actions. Deep water features like rivers and lakes are treated as blocking terrain for movement, but have no effect on ranged combat actions.

Low walls are special types of hindering terrain. Movement stops when a player's warrior 90 reaches the far side of a low wall, and speed is never halved on subsequent turns when that player's warrior 90 moves away from a low wall. Ranged combat attacks use the hindering terrain modifier for crossing the low wall, except if the firer is in base contact with the low wall. Close combat attacks are allowed between adjacent figures 80 on opposite sides of a low wall as if they were in base contact.

Abrupt elevated terrain such as raised parapets, flat rooftops, and plateaus flanked by cliffs are treated like normal elevated terrain except that close combat attacks are not allowed. Formations are also not allowed to be broken between levels of an abrupt elevated terrain. Figures 80 may only move onto or off of such terrain if they have special abilities or a ladder or stairway exists.

Height Advantage: When a firer that is not on elevated terrain makes a ranged combat attack against an elevated target, the target's defense value is increased by one. This is the height advantage modifier. When using a ranged combat formation, only the primary attacker's line of fire is subject to the height advantage modifier and the hindering terrain modifier.

Close combat between figures 80 at different elevations is allowed if the bases 10 would be in contact if not for the height difference. If the target of a close combat attack is elevated while the attacking warrior 90 is not, the target gets the height advantage modifier.

Ending the Game: The game ends when any of the following occur: a) Only one player remains with a warrior 90 on the battlefield; b) A predetermined time limit for the game expires; or c) All remaining players agree to end the game. A player may also decide to withdraw during their turn. If a player decides to withdraw, the player removes all of the player's remaining warriors 90 from the game.

The winner of the game is determined by the player with the highest number of victory points. Victory points are accumulated by eliminating opposing warriors 90, maintaining captured warriors 90, and by one's own surviving warriors 90. The points awarded for eliminating an opposing warrior 90 is the point value of that warrior 90. The points awarded for holding a warrior 90 captive at the end of the game is twice the point value of the captured warrior 90. The points accumulated for each surviving warrior 90 is equal to that warrior's point value. After the game, all players retrieve their eliminated and captured figures 80.

Various features of the invention are set forth in the following claims.

What is claimed is:

1. A game piece for use in a game, the game piece comprising:

a self-contained record-keeping device, wherein the record-keeping device adjustably displays variable information relating to the game, the information being arranged in a plurality of selectable groupings of game play indicia, each grouping including a plurality of different types of game play indicia, each type of indicia indicating information related to a different aspect of the play of the game and being expressed as game play values, the indicia of one type in at least some of the groupings having game play values different from the indicia of the same type in others of the groupings; and an indicator selectively manually movable between a plurality of positions corresponding to the groupings to select one of the groupings for use of the game play indicia thereof to determine game play, the indicator including an aperture in a member, the member being selectively movable to align the aperture with the selected one of the groupings to allow viewing of the indicia of the selected grouping to determine game play.

2. The game piece of claim 1 wherein the positional relationship of the types of indicia within each grouping is the same among the groupings.

3. The game piece of claim 1 for use in playing a game based on simulated interactions of at least two game pieces according to a set of game rules, wherein the game play values are selected to produce outcomes of the simulated interactions between the game pieces according to the set of game rules by comparison of the game play values of the game play indicia in selected groupings of the game pieces.

4. The game piece of claim 1 wherein the aperture is sized to allow viewing of the indicia of the selected grouping without revealing any indicia of the other groupings.

5. The game piece of claim 1 wherein the indicator further includes view-blocking portion movable with the member and blocking viewing of the indicia of the other groupings.

6. The game piece of claim 1 further including a gripable member exposed for grasping by a hand of a game player, the gripable member being operatively connected to the indicator to selectively manually move the indicator in response to movement of the gripable member between the plurality of positions corresponding to the groupings to select the one of the groupings for use of the game play indicia thereof to determine game play.

7. The game piece of claim 1 further including a retainer member releasably retaining the indicator in the position corresponding to the selected grouping to which moved until the indicator is selectively manually moved to another position corresponding to a different selected one of the groupings.

8. The game piece of claim 1 wherein at least some of the game play values of the indicia are indicated by numbers.

9. The game piece of claim 1 wherein at least some of the game play values of the indicia are indicated by colors.

10. The game piece of claim 1 wherein at least some of the game play values of the indicia are indicated by symbols.

11. The game piece of claim 1 wherein at least some of the game play values of the indicia are indicated by combinations of at least two of numbers, colors and symbols.

12. A movable game piece for use in playing a game where the game piece is moved about a playing surface during play of the game, the game piece comprising:

a selector member having a plurality of groupings of game play indicia with the groupings at spaced-apart grouping positions, each grouping including a plurality of different types of game play indicia, each type of indicia indicating information related to a different aspect of play of the game and being expressed as game play numerical values, the positional relationship of the types of indicia within each grouping being the same among the groupings, the indicia of one type in at least some of the groupings having game play numerical values different from the indicia of the same type in others of the groupings;

a base member movably coupled to the selector member and selectively manually movable relative to the selector member in first and second opposite directions between a plurality of base member positions corresponding to the grouping positions, the base member having at least one aperture sized and positioned to be in alignment with the correspondingly positioned one of the groupings to allow viewing of the indicia thereof to determine game play without revealing any indicia of the other groupings; and a retainer member releasably retaining the base member in the selected base member position to which moved while the game piece is moved about the playing surface until the base member is selectively manually moved to another selected one of the base member positions.

13. The game piece of claim 12 wherein the indicia of one type in a plurality of the grouping has a game play numerical value being one of the same and greater than the game play numerical value of the indicia of the same type in an adjacent one of the groupings.

14. A movable game piece for use in playing a game, the game piece comprising:

a selector member having a plurality of game play indicia at spaced-apart indicia positions;

a base member selectively manually movable relative to the selector member between a plurality of base member positions corresponding to the indicia positions, the base member having at least one aperture sized and positioned to be in alignment with the correspondingly positioned one of the indicia to allow viewing of the indicia to determine game play without revealing any others of the indicia; and a retainer member releasably retaining the base member in the selected base member position to which moved while the game piece is moved about until the base member is selectively manually moved to another selected one of the base member positions.

15. The game piece of claim 14 wherein the retainer member includes a plurality of first members and a second member, the first members being spaced-apart on one of the selector member and the base member and in positions corresponding to the plurality of base member positions, the second member being on the other of the selector member and the base member, the second member being intractable with each of the plurality of first members to retain the base member in the selected base member position to which moved.

16. A game piece for use in playing a game, the game piece comprising:

a selector member having a plurality of groupings of game play indicia with the groupings at spaced-apart grouping positions, each grouping including a plurality of different types of game play indicia, each type of indicia indicating information related to a different aspect of play of the game, the positional relationship of the types of indicia within each grouping being the same among the groupings; and a base member selectively manually movable relative to the selector member between a plurality of base member positions corresponding to the grouping positions, the base member having at least one aperture sized and positioned to be in alignment with the correspondingly positioned one of the groupings to allow viewing of the indicia thereof to determine game play without revealing any indicia of the other groupings.

17. The game piece of claim 16 further comprising a retainer member releasably retaining the base member in the selected base member position to which moved while the game piece is moved about until the base member is selectively manually moved to another selected one of the base member positions.

18. A movable game piece for use by a game player in playing a game, the game piece comprising:

a selector member having a plurality of discrete groupings of game play indicia, each grouping including a plurality of different types of game play indicia, each type of indicia indicating information related to a different aspect of play of the game, the selector member having a gripable portion exposed for grasping by one hand of the game player; and a base member having an indicator portion selectively manually movable relative to the selector member to selectively position the indicator portion to indicate one of the groupings for use of the indicia thereof to determine game play, the base member having a gripable portion exposed for grasping by an other hand of the game player, the gripable portion of the base member being operatively connected to the indicator portion to move the indicator portion relative to the selector member in response to the game player grasping the gripable portion of the base member in the one hand and the gripable portion of the selector member in the other hand and moving the gripable portion of the base member relative to the gripable portion of the selector member in an amount sufficient to selectively position the indicator portion to indicate one of the groupings.

19. The game piece of claim 18 wherein the indicator portion of the base member includes at least one aperture sized and positioned such that when moved into alignment with the indicated one of the groupings the indicia thereof are visible therethrough for use to determine game play, and the base member further includes a view-blocking portion movable with the indicator portion and blocking viewing of the indicia of the other groupings.

20. The game piece of claim 18 wherein the indicator portion of the base member includes a view-permitting portion sized and positioned such that when moved into alignment with the indicated one of the groupings the indicia thereof are visible through the view-permitting portion for use to determine game play, and the base member further includes a view-blocking portion movable with the indicator portion and blocking viewing of the indicia of the other groupings.

21. The game piece of claim 18 for use in playing a game based on simulated interactions of a plurality of game characters according to a set of game rules, wherein the base member includes a representational figure representing one of the game characters and the groupings of game play indicia of the selector member are expressed as game play numerical values uniquely associated with the one game character to produce outcomes of the simulated interactions with other game characters using the game play indicia of the respective characters according to the set of game rules.

22. The game piece of claim 18 further comprising a retainer member releasably retaining the base member against movement relative to the selector member while permitting the base member to be selectively manually moved relative to the selector member to selectively position the indicator portion to indicate the one of the groupings for use of the indicia thereof to determine game play.

23. The game piece of claim 18 wherein the selector and base members are rotatably coupled together, and one of the selector and base members is a disk having a plurality of first engagement portions, and the other of the selector and base members has a second engagement portion retainingly interactable with the plurality of first engagement portions as one of the selector and base members is rotated relative to the other, the plurality of first engagement portions being positioned to correspond to positions of the plurality of discrete groupings of game play indicia.

24. The game piece of claim 18 wherein at least a first plurality of the types of game play indicia are expressed as game play values represented by at least one of numbers, colors and symbols, and the indicia thereof in at least some of the groupings have game play values different from the indicia of the same type in others of the groupings.

25. The game piece of claim 24 wherein the indicia of the first plurality of the types in a plurality of the groupings have game play values represented by numbers being one of the same and greater than the game play numbers of the indicia of the same type in an adjacent one of the groupings.

26. The game piece of claim 18 for use in playing a game based on simulated interactions of a plurality of game characters according to a set of game rules with the game play outcomes of the simulated interactions depending on the relative values of one or more of speed, attack, defense and damage for the interacting game characters, wherein the game play indicia of each grouping are representative of at least two of speed, attack, defense and damage.

27. A movable game piece for use in playing a game, the game piece, comprising:

a first member having a plurality of game play indicia;

a second member having an indicator portion, one of the first and second members having a contact portion and being selectively manually movable relative to the other of the first and second members in response to a user manually drivingly contacting the contact portion to selectively position the indicator portion to indicate one of the indicia for use to determine game play wherein the indicator portion of the second member includes at least one aperture sized and positioned such that when said aperture is moved into alignment with the indicated one of the indicia the indicated one of the indicia is visable therethrough for use to determine game play without revealing any others of the indicia; and a retainer member releasably retaining the first and second members against relative movement while permitting the one of the first and second members to be selectively manually moved relative to the other of the first and second members to selectively position the indicator portion to indicate the one of the indicia for use to determine game play.

28. The game piece of claim 27 wherein the retainer member includes a plurality of first retainer members and a second retainer member, the first retainer members being spaced-apart on one of the first and second members and the second retainer member being on the other of the first and second members, the second retainer member being interactable with each of the plurality of first retainer members to retain the first and second members against relative movement with the indicator portion positioned to indicate the one of the indicia for use until the one of the first and second members is selectively manually moved relative to the other of the first and second members to position the indicator to indicate another one of the indicia for use to determine game play.

29. The game piece of claim 27 wherein the first member has the plurality of game play indicia at spaced-apart indicia positions, and the second member is selectively manually movable relative to the first member between a plurality of second member positions corresponding to the indicia positions, the indicator portion being arranged such that when the second member is in one of the second member positions the indicator portion is in alignment with the correspondingly positioned one of the indicia positions.

30. The game piece of claim 27 wherein the indicator portion of the second member includes a view-permitting portion sized and positioned such that when moved into alignment with the indicated one of the indicia the indicia one of the indicia is visible through the view-permitting portion for use to determine game play, and the second member further includes a view-blocking portion movable with the indicator portion and blocking viewing of the other indicia.

31. The game piece of claim 27 wherein the first and second members are rotatably coupled together, and one of the first and second members is a disk having a plurality of first engagement portions, and the other of the first and second members has a second engagement portion retainingly interactable with the plurality of first engagement portions as one of the first and second members is rotated relative to the other, the plurality of first engagement portions being positioned to retain the first and second members with the indicator portion positioned in positions corresponding to positions of the plurality of game play indicia.

32. The game piece of claim 27 wherein the first member includes a first disk and the second member includes a second disk, the first and second disks being rotatably coupled together, one of the first and second disks having an edge including a plurality of first engagement portions, and the other of the first and second disks having a second engagement portion retainingly interactable with the plurality of first engagement portions as one of the first and second disks is rotated relative to the other, the plurality of first engagement portions being positioned to retain the first and second members with the indicator portion positioned in positions corresponding to positions of the plurality of game play indicia.

33. The game piece of claim 32 wherein the first engagement portions include a plurality of indentations, and the second engagement portion includes a button retainingly interactable with the plurality of indentations.

34. The game piece of claim 27 wherein the first member has a label with the game play indicia being recorded thereon.

35. The game piece of claim 27 wherein the game play indicia indicate information related to one or more aspects of play of the game and are expressed as at least one of qualitative and quantitative values.

36. The game piece of claim 35 wherein at least some of the game play values of the indicia are expressed by numbers.

37. The game piece of claim 35 wherein at least some of the game play values of the indicia are expressed by colors.

38. The game piece of claim 35 wherein at least some of the game play values of the indicia are expressed by symbols.

39. The game piece of claim 35 wherein at least some of the game play values of the indicia are expressed by combinations of at least two of numbers, colors and symbols.

40. A movable game piece for use in playing a game, the game piece comprising:

a first member having a plurality of discrete groupings of game play indicia, each grouping including a plurality of different types of game play indicia, each type of indicia indicating information related to a different aspect of play of the game; and a second member having an indicator portion positioned to indicate one of the groupings for use of the indicia thereof to determine game play, one of the first and second members having a contact portion and being selectively manually movable relative to the other of the first and second members in response to a user manually drivingly contacting the contact portion to selectively position the indicator portion to indicate the one of the groupings wherein the indicator portion of the second member includes at least one aperture sized and positioned such that when said aperture is moved into alignment with the indicated one of the groupings the indicia thereof are visable therethrough for use to determine game play without revealing any indicia of the other groupings.

41. The game piece of claim 40 wherein the indicator portion of the second member includes a view-permitting portion sized and positioned such that when moved into alignment with the indicated one of the groupings the indicia thereof are visible through the view-permitting portion for use to determine game play, and the second member further includes a view-blocking portion movable with the indicator portion and blocking viewing of the indicia of the other groupings.

42. The game piece of claim 40 further comprising a retainer member releasably retaining the one of the first and second members against movement relative to the other of the first and second members while permitting the one of the first and second members to be selectively manually moved relative to the other of the first and second members to selectively position the indicator portion to indicate the one of the groupings for use of the indicia thereof to determine game play.

43. The game piece of claim 40 wherein the first and second members are rotatably coupled together, and one of the first and second members is a disk having a plurality of first engagement portions, and the other of the first and second members has a second engagement portion retainingly interactable with the plurality of first engagement portions as one of the first and second members is rotated relative to the other, the plurality of first engagement portions being positioned to correspond to positions of the plurality of discrete groupings of game play indicia.

44. The game piece of claim 40 wherein the first member includes a first disk and the second member includes a second disk, the first and second disks being rotatably coupled together, one of the first and second disks having an edge including a plurality of first engagement portions, and the other of the first and second disks having a second engagement portion retainingly interactable with the plurality of first engagement portions as one of the first and second disks is rotated relative to the other, the plurality of first engagement portions being positioned to correspond to positions of the plurality of discrete groupings of game play indicia.

45. The game piece of claim 44 wherein the first engagement portions include a plurality of indentations, and the second engagement portion includes a button retainingly interactable with the plurality of indentations.

46. The game piece of claim 40 wherein at least a first plurality of the types of game play indicia are expressed as game play values represented by at least one of numbers, colors and symbols, and the indicia thereof in at least some of the groupings have game play values different from the indicia of the same type in others of the groupings.

47. The game piece of claim 46 wherein the indicia of the first plurality of the types in a plurality of the groupings have game play values represented by numbers being one of the same and greater than the game play numbers of the indicia of the same type in an adjacent one of the groupings.

48. The game piece of claim 40 for use in playing a game based on simulated interactions of a plurality of game characters according to a set of game rules, wherein one of the first and second members has a base portion with a representational figure attached thereto and representing one of the game characters, and wherein the groupings of game play indicia of the first member are expressed as game play values uniquely associated with the one game character to produce outcomes of the simulated interactions with other game characters using the game play indicia of the respective characters according to the set of game rules.

49. The game piece of claim 48 wherein the figure is the contact portion.

50. The game piece of claim 40 wherein the first and second members are rotatably coupled together and the one of the first and second members is selectively manually rotatable relative to the other of the first and second members in response to the user manually applying a rotational drive force to the contact portion to selectively position the indicator portion to indicate the one of the groupings.

51. The game piece of claim 50 wherein the first and second members are rotatably coupled together to rotate about a rotational axis, the game play indicia of each of the groupings indicate a different state of the game piece, the groupings are arranged sequentially from a first grouping to a last grouping the state of the game piece represented by the values of the game play indicia of the groupings progressively changes from the first grouping to the last grouping, and the game play indicia of each of the groupings are arranged in a column extending radially outward from the rotational axis.

52. The game piece of claim 40 wherein the first member has a label with the game play indicia being recorded thereon.

53. The game piece of claim 40 wherein each of the game play indicia are expressed as at least one of qualitative and quantitative values, and the game play indicia of each of the groupings indicate a different state of the game piece.

54. The game piece of claim 53 wherein the groupings are arranged sequentially from a first grouping to a last grouping, and the state of the game piece is represented by the values of the game play indicia of the groupings progressively changes from the first grouping to the last grouping.

55. The game piece of claim 40 wherein at least some of the game play indicia are expressed as game play values represented by numbers.

56. The game piece of claim 40 wherein at least some of the game play indicia are expressed as game play values represented by colors.

57. The game piece of claim 40 wherein at least some of the game play indicia are expressed as game play values represented by symbols.

58. The game piece of claim 40 wherein at least some of the game play indicia are expressed as game play values represented by combinations of at least two of numbers, colors and symbols.

59. The game piece of claim 40 wherein the first and second members are rotatably coupled together to rotate about a rotational axis, the game play indicia of each of the groupings indicate a different state of the game piece, the groupings are arranged sequentially from a first grouping to a last grouping, the state of the game piece represented by the values of the game play indicia of the groupings progressively changes from the first grouping to the last grouping, and the game play indicia of each of the groupings are in a radially extending arrangement extending relative to the rotational axis.

60. The game piece of claim 40 for use in playing a game based on simulated interactions of a plurality of game characters, wherein the contact portion is a figure representative of one of the game characters.

61. The game piece of claim 40 wherein the first and second members are first and second disks, respectively, rotatably coupled together for rotation about a common rotational axis.

62. The game piece of claim 61 wherein the groupings are arranged sequentially from a first grouping to a last grouping, the game play indicia of each of the groupings indicate a different state of the game piece, the state of the game piece represented by the values of the game play indicia of the groupings progressively changes from the first grouping to the last grouping, and wherein the one of the first and second disks is rotatable relative to the other about the rotational axis in both clockwise and counterclockwise directions, whereby during play of the game the state of the game piece represented by the values of the game play indicia of the groupings can be changed by rotating the one of the first and second disks in one of the clockwise and counterclockwise directions and later returned to a prior state by subsequent rotation of the one of the first and second disks in the other of the clockwise and counterclockwise directions.

63. The game piece of claim 61 wherein one of the first and second disks has a first perimeter portion, and the other of the first and second disks has a second perimeter portion positioned adjacent to the first perimeter portion, the other of the first and second disks has a plurality of fingers at the second perimeter portion retaining the first perimeter portion to retain the first and second disks together while permitting relative rotation of the first and second disks about the rotational axis.

64. The game piece of claim 61 wherein one of the first and second disks has an first engagement member.

65. The game piece of claim 40 wherein the second member further includes a plurality of additional game play indicia of different types than the indicia of the first member, and the additional game play indicia are visible when the indicator portion is positioned to indicate any of the groupings.

66. A movable game piece for use in a game, the game piece comprising:

a self-contained mechanical record-keeping device having a selector member and a base member, the selector member having a plurality of groupings of game play indicia with the groupings at spaced-apart positions and having a portion exposed for grasping by a user, each grouping including a plurality of different types of game play indicia, each type of indicia indicating information related to a different aspect of the play of the game, and the base member having an aperture sized to allow viewing of the indicia of one of the groupings without revealing any indicia of the other groupings, the base member being selectively manually movable relative to the selector member between a plurality of positions corresponding to the grouping positions with the base aperture at each base member position being positioned in alignment with the correspondingly positioned one of the groupings to allow viewing of the indicia of the grouping to determine game play, the base member having a portion exposed for grasping by a user.

67. The game piece of claim 66 further including a retainer member releasably holding the base member in the base member position to which moved as the game piece is moved about until the base member is selectively manually moved to another one of the base member positions.

68. A set of at least first and second movable game pieces for use by first and second game players, respectively, in playing a game based on simulated interactions of the first and second game pieces according to a set of game rules, each of the first and second game pieces comprising:

a first member having a plurality of discrete groupings of game play indicia, each grouping including a plurality of different types of game play indicia, each type of indicia indicating information related to a different aspect of play of the game and being expressed as game play values, the game play values being selected to produce outcomes of the simulated interactions between the first and second game pieces according to the set of game rules by comparison of a number determined based upon the game play values of the game play indicia in one grouping of the first game piece with a number determined based upon the game play values of the game play indicia in one grouping of the second game piece, the game play values of a plurality of the game play indicia in at least one of the groupings of the first game piece having different values than the game play values of a plurality of the game play indicia of the same type in at least one of the groupings of the second game piece; and a second member having an indicator portion positioned to indicate one of the groupings for use of the indicia thereof to determine the number used for comparison, one of the first and second members being selectively manually movable relative to the other of the first and second members to selectively position the indicator portion to indicate the one of the groupings wherein the indicator portion of the second member includes at least one aperture sized and positioned such that when said aperture is moved into alignment with the indicated one of the groupings the indicia thereof are visable therethrough for use to determine game play without revealing any indicia of the other groupings.

69. The set of game pieces of claim 68 wherein each of the first and second game pieces further comprising a retainer member releasably retaining the one of the first and second members against movement relative to the other of the first and second members while permitting the one of the first and second members to be selectively manually moved relative to the other of the first and second members to selectively position the indicator portion to indicate the one of the groupings.

70. The set of game pieces of claim 68 wherein for each of the first and second game pieces at least a plurality of the types of game play indicia are expressed as game play values.

71. The set of game pieces of claim 70 wherein for each of the first and second game pieces the game play indicia in at least some of the groupings have game play values different from the game play indicia of the same type in others of the groupings.

72. The set of game pieces of claim 71 wherein for each of the first and second game pieces at least two of the game play indicia of the same type in at least two adjacent groupings have game play values represented by numbers and the game play numbers in one adjacent grouping are different than the game play numbers in the other adjacent grouping.

73. The set of game pieces of claim 68 wherein the game play indicia are expressed as at least one of qualitative and quantitative values.

74. The set of game pieces of claim 68 wherein at least some of the game play indicia are expressed as game play values represented by numbers.

75. The set of game pieces of claim 68 wherein at least some of the game play indicia are expressed as game play values represented by colors.

76. The set of game pieces of claim 68 wherein at least some of the game play indicia are expressed as game play value represented by symbols.

77. The set of game pieces of claim 68 wherein at least some of the game play indicia are expressed as game play values represented by combinations of at least two of numbers, colors and symbols.

78. The set of game pieces of claim 68 wherein for each of the first and second game pieces one of the first and second members has a base portion with a representational figure attached thereto representing a game characters having characteristics, the figure for the first game piece being different that the figure for the second game piece, and wherein the game play values of the game play indicia represent the characteristics of the game character represented by the attached figure.

79. The set of game pieces of claim 68 wherein for each of the first and second game pieces the first and second members are rotatably coupled together and the one of the first and second members is selectively manually rotatable relative to the other of the first and second members to selectively position the indicator portion to indicate the one of the groupings.

80. The set of game pieces of claim 68 wherein the first member has a label with the game play indicia being recorded thereon.

81. A self-contained record-keeping device for use in playing a game, comprising:

a first member having a plurality of groupings of game play indicia with the groupings at spaced-apart grouping positions, each grouping including a plurality of different types of game play indicia, each type of indicia indicating information related to a different aspect of play of the game and being expressed as game play values, the positional relationship of the types of indicia within each grouping being the same among the groupings, the indicia of one type in at least some of the groupings having game play values different from the indicia of the same type in others of the groupings;

a second member movably coupled to the first member and selectively manually movable relative to the first member in first and second opposite directions between a plurality of second member positions corresponding to the grouping positions, the second member having at least one aperture sized and positioned to be in alignment with the correspondingly positioned one of the groupings to allow viewing of the indicia thereof to determine game play without revealing any indicia of the other groupings; and a retainer member releasably retaining the second member in the selected second member position to which moved while permitting the second member to be selectively manually moved to another selected one of the second member positions.

82. The device of claim 81 in the indicia of one type in a plurality of the groupings has a game play value being different than the game play value of the indicia of the same type in an adjacent one of the groupings.

83. The device of claim 81 wherein at least some of the game play values of the indicia are represented by at least one of numbers, colors and symbols.

84. A self-contained record-keeping device for use in playing a game, comprising:

a first member having a plurality of game play indicia;

a second member having an indicator portion, one of the first and second members being selectively manually movable relative to the other of the first and second members to selectively position the indicator portion to indicate one of the indicia for use to determine game play wherein the indicator portion of the second member includes at least one aperture sized and positioned such that when said aperture is moved into alignment with the indicated one of the indicia, said indicia is visable therethrough for use to determine game play without revealing any other indicia; and a retainer member releasably retaining the first and second members against relative movement while permitting the one of the first and second members to be selectively manually moved relative to the other of the first and second members to selectively position the indicator portion to indicate the one of the indicia for use to determine game play, the retainer member includes a plurality of first retainer members and a second retainer member, the first retainer members being spaced-apart on one of the first and second members and the second retainer member being on the other of the first and second members, the second retainer member being interactable with each of the plurality of first retainer members to retain the first and second members against relative movement with the indicator portion positioned to indicate the one of the indicia for use until the one of the first and second members is selectively manually moved relative to the other of the first and second members to position the indicator to indicate another one of the indicia for use to determine game play.

85. The device of claim 84 wherein the first member has the plurality of game play indicia at spaced-apart indicia positions, and the second member is selectively manually movable relative to the first member between a plurality of second member positions corresponding to the indicia positions, the indicator portion being arranged such that when the second member is in one of the second member positions the indicator portion is in alignment with the correspondingly positioned one of the indicia positions.

86. The device of claim 84 wherein the indicator portion of the second member includes at least one aperture sized and positioned such that when moved into alignment with the indicated one of the indicia the indicated one of the indicia is visible therethrough for use to determine game play without revealing any others of the indicia.

87. The device of claim 84 wherein the indicator portion of the second member includes a view-permitting portion sized and positioned such that when moved into alignment with the indicated one of the indicia the indicia one of the indicia is visible through the view-permitting portion for use to determine game play, and the second member further includes a view-blocking portion movable with the indicator portion and blocking viewing of the other indicia.

88. The device of claim 84 wherein the first member has a label with the game play indicia being recorded thereon.

89. The device of claim 84 wherein the game play indicia indicate information related to one or more aspects of play of the game and are expressed as at least one of qualitative and quantitative values.

90. The device of claim 89 wherein at least some of the game play values of the indicia are expressed by numbers.

91. The device of claim 89 wherein at least some of the game play values of the indicia are expressed by colors.

92. The device of claim 89 wherein at least some of the game play values of the indicia are expressed by symbols.

93. The device of claim 89 wherein at least some of the game play values of the indicia are expressed by combinations of at least two of numbers, colors and symbols.

94. A method for playing a game according to a set of game rules, the method comprising the acts of:

placing at least first and second movable game pieces on a playing surface for use by at least first and second game players, respectively, in playing a game based on simulated interactions of the first and second game pieces according to the set of game rules, each of the first and second game pieces including a self-contained record-keeping device having first and second members, the first member having a plurality of discrete groupings of game play indicia, each grouping including a plurality of different types of game play indicia, each type of indicia indicating information related to a different aspect of play of the game and being expressed as game play values, the game play values being selected to produce outcomes of the simulated interactions between the first and second game pieces according to the set of game rules by comparison of a number determined based upon the game play values of the game play indicia in one grouping of the first game piece with a number determined based upon the game play values of the game play indicia in one grouping of the second game piece, the game play values of a plurality of the game play indicia in at least one of the groupings of the first game piece having different values than the game play values of a plurality of the game play indicia of the same type in at least one of the groupings of the second game piece, and a second member having an indicator portion positioned to indicate one of the groupings for use of the indicia thereof to determine the number used for comparison, one of the first and second members being selectively manually movable relative to the other of the first and second members to selectively position the indicator portion to indicate the one of the groupings;

for each of the first and second game pieces initially moving the one of the first and second members to selectively position the indicator portion thereof to indicate an initial selected one of the groupings according to the set of game rules;

engaging the first and second game pieces in an initial simulated interaction according to the set of game rules;

comparing the number determined based upon the game play values of the game play indicia of the initial selected one of the groupings of the first game piece to the number determined based upon the game play values of the game play indicia in the selected initial one of the groupings of the second game piece, and based on the comparison determining an outcome of the initial simulated interaction between the first and second game pieces according to the set of game rules; and thereafter in turns according to the set of game rules until the game is over, repeatedly moving the one of the first and second members of at least one of the first and second game pieces according to the set of game rules to selectively position the indicator portion thereof to indicate a selected one of the groupings, engaging the first and second game pieces in a simulated interaction according to the set of game rules, and comparing the number determined based upon the game play values of the game play indicia of the selected one of the groupings of the first game piece to the number determined based upon the game play values of the game play indicia in the selected one of the groupings of the second game piece, and based on the comparison determining an outcome of the simulated interaction between the first and second game pieces according to the set of game rules.

95. The method of claim 94 wherein the moving of the one of the first and second members of at least one of the first and second game pieces comprises moving the one of the first and second members of at least one of the first and second game pieces in one direction if one outcome of the simulated interaction resulted during a prior turn and in an opposite direction if another different outcome of the simulated interaction resulted during the prior turn, and moving the one of the first and second members of the at least one of the first and second, game pieces to be moved so as to position the indicator portion thereof to indicate the grouping immediately adjacent to the previously selected one of the groupings.

96. The method of claim 95 wherein the groupings of game play indicia of the first member of each of the first and second game pieces are arranged sequentially from a first grouping to a last grouping, the game play indicia of each of the groupings indicate a different state of the game piece, and the state of the game piece represented by the values of the game play indicia of the groupings progressively changes from the first grouping to the last grouping, wherein during play of the game the state of the game piece represented by the values of the game play indicia of the groupings is changed by moving the one of the first and second members in the one direction and later returned to a prior state by subsequent movement of the one of the first and second members in the opposite direction.

97. The method of claim 94 wherein the groupings of game play indicia of the first member of each of the first and second game pieces are arranged sequentially from a first grouping to a last grouping, the game play indicia of each of the groupings indicate a different state of the game piece, and the state of the game piece represented by the values of the game play indicia of the groupings progressively changes from the first grouping to the last grouping.

98. The method of claim 94 wherein the second member of each of the first and second game pieces further includes a plurality of additional game play indicia of different types than the indicia of the first member, and the additional game play indicia are visible when the indicator portion is positioned to indicate any of the groupings, and wherein the additional game play indicia alter the values of the game play indicia of the selected ones of the groupings of the first and second game pieces according to the set of game rules for purposes of comparing the game play values of the game play indicia of the selected ones of the groupings of the first and second game pieces during at least one of the turns.

99. A game piece for use in a game, the game piece comprising:

a self-contained record-keeping device adjustable displaying variable information relating to the game and including a mechanism to limit viewing of the information, the mechanism including a selector disk and a base disk having an aperture therein, the base disk being rotatable relative to the selector disk between a plurality of indexed positions, the self-contained record-keeping device further including a label between the base disk and the selector disk, the information being printed on the label and arranged in a plurality of groups, the base disk limiting viewing to one group at a time in the indexed positions, one of the base and selector disks having an edge including a plurality of indentations, and the other of the base and selector disks having a button interactable with the plurality of indentations defining the plurality of indexed positions.

100. A game piece for use in a game, the game piece comprising:

a representational figure; and a self-contained record-keeping device that selectively displays variable information relating to the game, the self-contained record-keeping device being incorporated into a game piece base having the figure attached to the game piece base, the game piece base comprising a base disk and a selector disk, the base disk being rotatable relative to the selector disk between a plurality of finite indexed positions, the base disk having a slot therethrough, the self-contained record-keeping device having a label between the base disk and the selector disk, the information being printed on the label and arranged in a plurality of groups, the base disk limiting viewing to one group at a time in the indexed positions, one of the base and selector disks having an edge including a plurality of indentations, and the other of the base and selector disks having a button interactable with the plurality of indentations defining the plurality of indexed positions.

101. A game piece for use in a game, the game piece comprising:

a figure; and a base coupled to the figure, the base including information relating to the game and a selecting device for selectively displaying a variable portion of the information, the selecting device including a base disk and a selector disk, the base disk being rotatable relative to the selector disk between a plurality of finite indexed positions, the base disk including a slot therethrough, the selecting device further including a label between the base disk and the selector disk, the information being printed on the label and arranged in a plurality of groups, the base disk limiting viewing to one group at a time in the indexed positions, one of the base and selector disks having an edge including a plurality of indentations, and the other of the base and selector disks having a button interactable with the plurality of indentations defining the plurality of indexed positions.

102. A method for playing a game, the method comprising the acts of: providing a plurality of game pieces, at least one game piece including a self-contained record-keeping device that selectively displays variable information relating to the game, the game pieces each including a representational figure, the figure of the game piece provided representing a character in the game, the character of the game piece provided having characteristics relating to the game and the information represents the characteristics the record-keeping device including a mechanism to limit viewing of the information, the mechanism including a selector disk and a base disk having an aperture therein, the base disk being rotatable relative to the selector disk between a plurality of indexed positions, the record-keeping device further including a label between the base disk and the selector disk, the information being printed on the label and arranged in a plurality of groups, the base disk limiting viewing to one group at a time in the indexed positions, one of the base and selector disks having an edge including a plurality of indentations, and the other of the base and selector disks having a button interactable with the plurality of indentations defining the plurality of indexed positions;

engaging the game pieces in play following a set of rules; and varying the information displayed on the record-keeping device of at least one game piece, the varied information displayed on the record-keeping device representing the current status of the game piece during game play.

* * * * *